US005784727A

United States Patent [19]

Perez Garcia

[11] Patent Number: 5,784,727

[45] Date of Patent: Jul. 28, 1998

[54] MOBILE UNIT FOR HAIR CARE SERVICES IN HOSPITALS AND SIMILAR LOCATIONS

[75] Inventor: AnaMaria Perez Garcia, Alcantara, Spain

[73] Assignee: Manuel Irago Garcia, Madrid, Spain

[21] Appl. No.: 609,272

[22] Filed: Mar. 1, 1996

[30] Foreign Application Priority Data

Mar. 1, 1995 [ES] Spain ..... 9500549
Feb. 23, 1996 [ES] Spain ..... 9500461

[51] Int. Cl.[6] ..... A45D 19/04
[52] U.S. Cl. ..... 4/516; 4/519; 4/523
[58] Field of Search ..... 4/515–523

[56] References Cited

U.S. PATENT DOCUMENTS 3,192,537 7/1965 Coffmann ..... 4/516
3,239,850 3/1966 Kiss ..... 4/559
3,694,826 10/1972 Pugh ..... 4/516
4,081,867 4/1978 Simeola ..... 4/516
4,998,302 3/1991 Silva ..... 4/516
5,014,371 5/1991 Heel ..... 4/516

*Primary Examiner*—Charles E. Phillips
*Attorney, Agent, or Firm*—Helfgott & Karas P.C.

[57] ABSTRACT

A mobile unit (1) equipped with wheels (3) and a handle (2), on the top portion of which is a tray (13) for hair-washing, the height of which is adjustable and which is equipped with a shower head (14); further equipped with two tanks (12), one for the supply of clean hot water and the other for the discharge of dirty water, which is emptied through a discharge (9), by means of a faucet, the hot water tank (12) being coupled to a heating thermostat (8); both the hot water tank and the cold water tank being activated by respective impeller pumps. The unit may optionally be divided into two laterally adjacent, physically independent interconnectable modules (1–1'), each equipped with means of making the unit mobile in order to facilitate maneuvering of the assembly in tight space areas.

2 Claims, 3 Drawing Sheets

MOBILE UNIT FOR HAIR CARE SERVICES IN HOSPITALS AND SIMILAR LOCATIONS

FIELD OF INVENTION

The invention refers to a mobile unit for performing hair care services in hospitals and similar locations, where the patient is virtually unable to perform specific personal hygiene tasks on his or her own, such as hair washing, shaving, etc. The unit includes all the items and means required for a person, preferably a hair care professional, to perform certain services, which hospitalized patients are unable to perform either for reasons of convenience or due to circumstances.

BACKGROUND INFORMATION AND PRIOR ART

For certain persons, hospital stays entail the necessity of having personal care services such as shaving, hair washing and hair-cutting performed by others, normally family members and/or health care personnel, although with considerable difficulty and even discomfort for the actual patient.

Notwithstanding, at other times, even health care personnel or family members are unable to perform properly functions such as hair washing and cutting, in which event the services of a professional is required, who also finds it difficult to provide the services due to a lack of appropriate facilities, there being no hot water available in the area or, obviously, no appropriate means for properly positioning the patient's head in order to perform this type of service. It is for this reason that, in the field of personal hygiene of the hospitalized patient and, specifically, with respect to particular tasks, a void appears to exist, which to date has not been filled.

SUMMARY OF THE INVENTION

The unit herein advocated has been designed to solve the aforementioned problem, insofar as such a unit is mobile and is easily transferred from one place to another. It is intended for use by the hair care professional, who is able to go from one place to another, such as from room to room in a hospital, and thereby perform specific services such as hair washing and hair cutting, shaving, etc., in the manner most convenient to patients and, obviously, to the hair care professional.

More specifically, the mobile unit is characterized by a properly installed tray, which can be moved vertically so as to be adapted to the height of the user adequately, the user either being seated on the bed or on a chair or, when used with a frame stand, to enable hair to be washed. The unit is further characterized by two tanks, one for clean water, which is connected to an electric thermostat for regulating the temperature of water by heating, and the other for used water, all with the required piping for discharging by means of a pump, together with the electric thermostat and impeller pump start-up devices. The unit is further equipped with shelving and appropriate doors, as required for the storage of all hair care utensils and accessories. The unit is complete with an upper side panel containing an articulated mirror support arm, which duly opens out to provide the user with a comfortable view of the services being performed.

This unit is complete with a frame stand for those cases, in which the patient is totally bedridden. The frame stand is equipped with two rings located on respective frame stand crossbeams, said rings supporting a rigid pipe attached to the tray, thus facilitating hair washing even when the patient is unable to get out of bed, a preferred embodiment of the unit being its use with the patient seated in a chair.

As is evident, the assembly is complete with a shower head connected by pipe to the pertinent flexible arm and to the clean water supply.

Consequently, by using the inventive unit, it is possible to provide hair care services to hospitalized patients in their own rooms. A need for in-patient hygiene and aesthetic services is thus fulfilled.

In accordance with a further characteristic of the invention, the unit may be constructed on the basis of two laterally adjacent and interconnectable modules, in order that such modules be made independent and used individually in narrow or reduced space areas.

DESCRIPTION OF DRAWINGS

In order to elaborate further on the foregoing description and to assist in providing a greater understanding of the characteristics of the invention, this descriptive summary is accompanied by the following set of drawings, which form an integral part of the invention and illustrate it without limiting it.

PREFERRED EMBODIMENT OF THE INVENTION

From the aforementioned Figures, it can be observed that the inventive unit comprises a parallelepipedic body (1), which on one side has a handle (2) for maneuvering, and is equipped on the underside with wheels (3), which enable it to be transported from one place to another.

Figure 1:
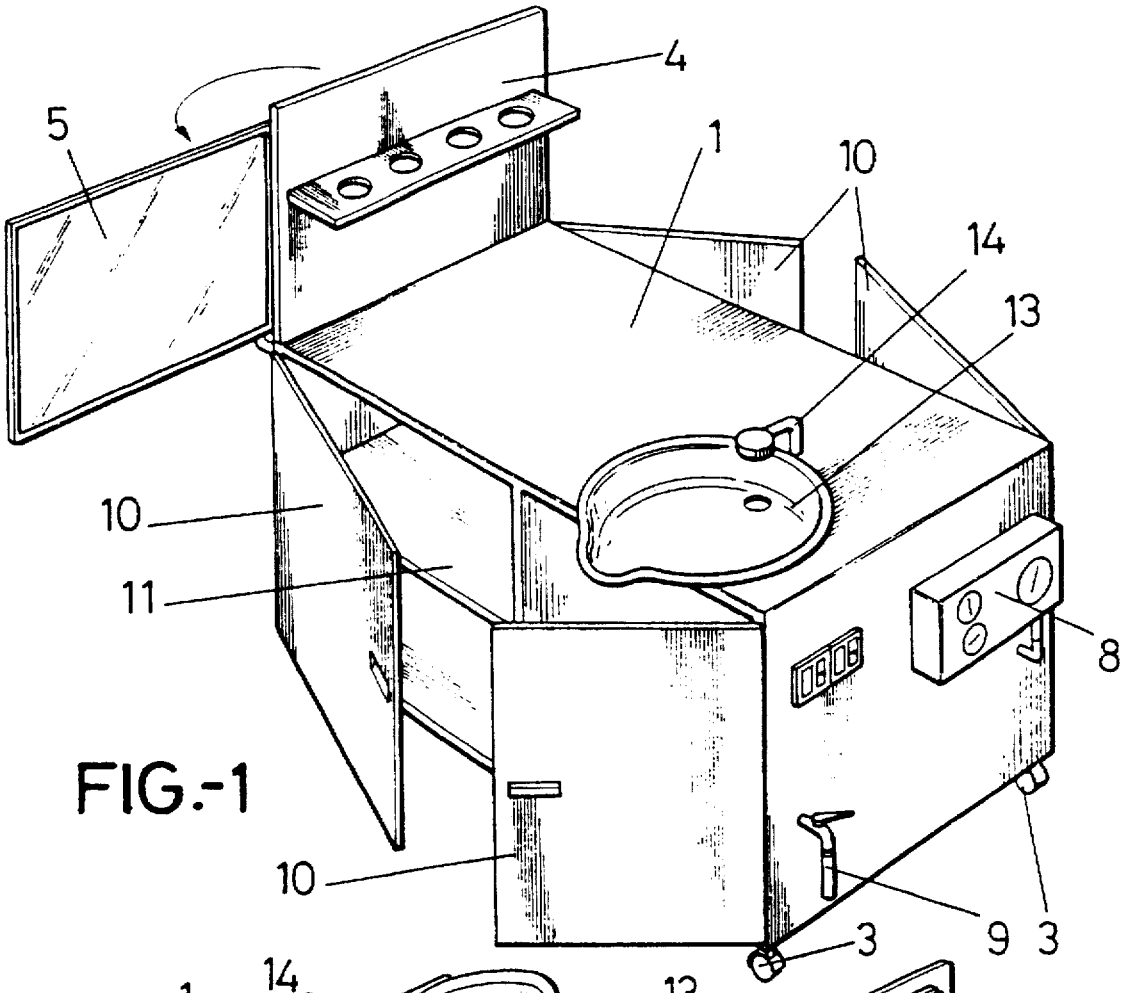
FIG. 1 shows a general perspective view of the inventive unit, with the doors half open and the mirror in the open or functional position.
Figure 2:
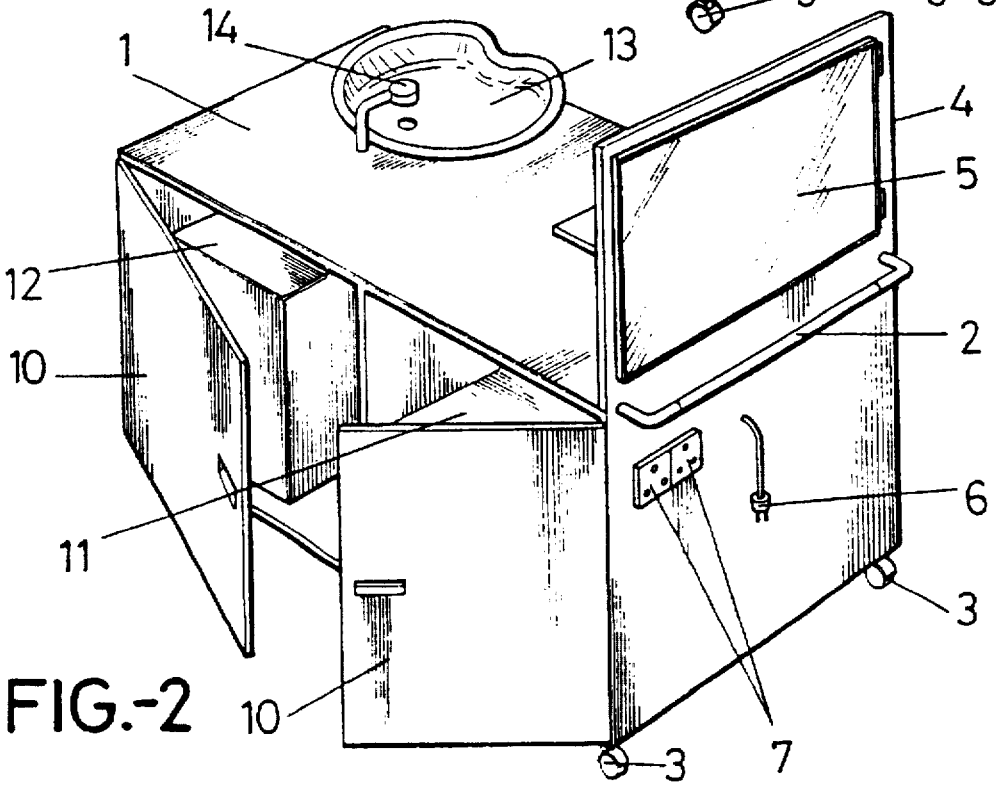
FIG. 2 also shows a perspective view of the unit shown in the preceding Figure, but from the opposite side.

The handle side (2) extends upwards in a vertical panel (4), to which a mirror (5) is hinged which, when folded, lies flat against the external face of the vertical panel (4) and, when opened, sits in the position shown in FIG. 1.

The unit is equipped with a power plug (6), a power outlet (7), protective fuses (21) as well as with a water heater for intake water (8) and a drain (9).

The largest surfaces of the unit (1) are enclosed by means of matching doors (10) which, when closed, hide internal shelving (11) as well as a pair of tanks (12), one for clean water heated by means of an electric thermostat and the other for dirty water.

The top of the unit (1) contains a tray (13) as well as a shower head (14) equipped with an extension, which is, of course, connected to the clean water tank (12).

In this way, the hair care professional is able to wheel the unit (1) from one place to the other and perform specific personal care services for hospitalized patients, such as hair washing and hair cutting. The hair washing is performed with the shower head located over the tray (13). The washing itself takes place using the shower head (14) and hot water supplied from the tank heated as described hereinbefore.

The tanks may be filled and emptied at any time, that is, when the clean, hot water tank has been emptied and the dirty water tank filled.

Figure 3:
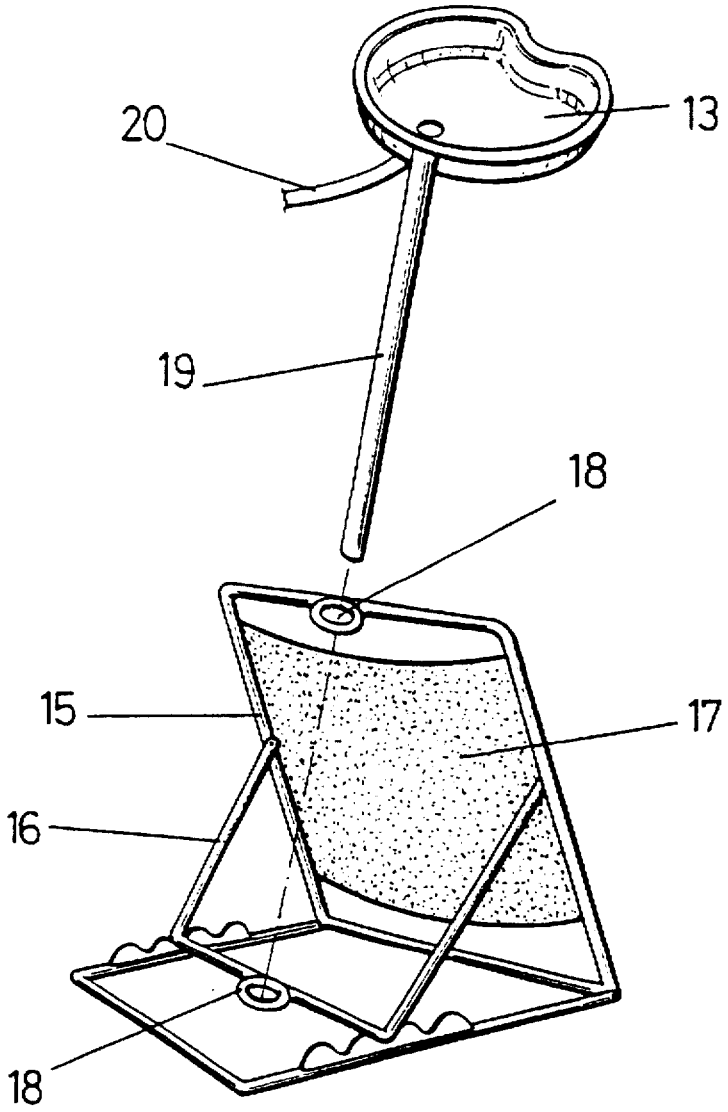
FIG. 3 shows a perspective representation of a duly structured frame stand detail for attaching a tray and permitting the use of the unit for providing hair care services to bedridden patients.

In the event that the patient, whose hair is to be washed and cut, is bedridden, a frame stand (15) is used as shown in FIG. 3. The angle of tilt of the frame stand (15) can be varied by means of an articulated support (16) into several positions to achieve a greater or smaller tilt of the frame stand itself (15). Such a frame stand is equipped with a changeable support fabric (17) and is further characterized by being equipped with an upper crossbeam and a lower crossbeam with a pair of rings (18), which face each other and through which a rigid pipe (19) from the tray (13), which has a flexible discharge pipe (20), may be passed in such a way that the pipe (19) is firmly locked between the aforementioned rings (18). The tray (13) thereby facilitates performing the appropriate task on a bedridden patient.

Figure 4:
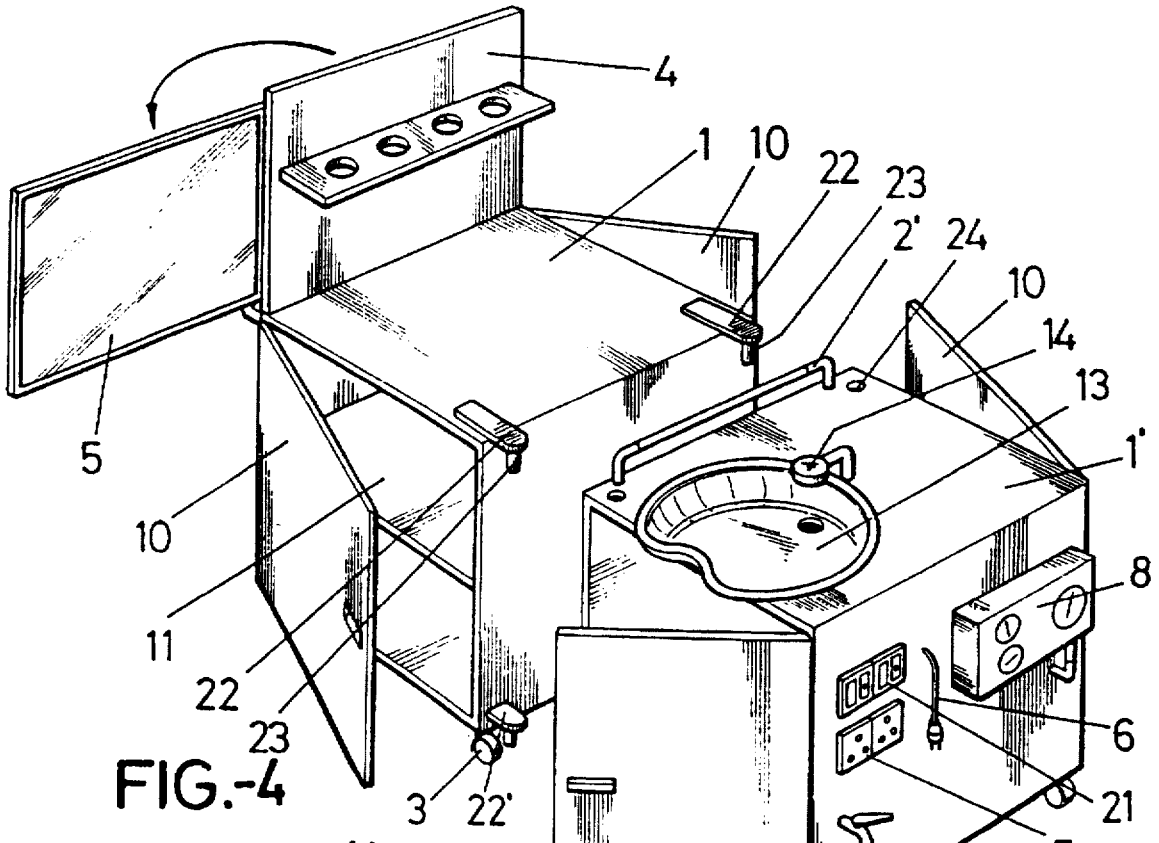
FIG. 4 shows a perspective view similar to that of FIG. 1, but corresponding to a variation of the embodiment, in which a modular construction is adopted.
Figure 5:
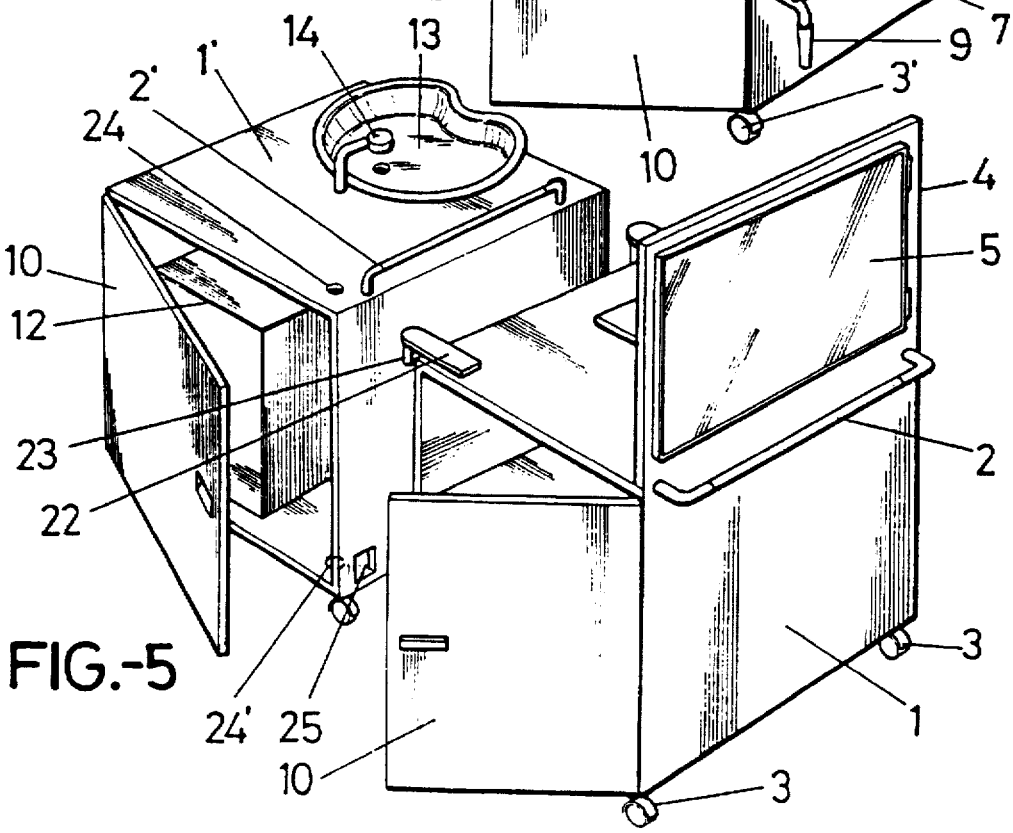
FIG. 5 finally shows a similar perspective view to that of FIG. 2, but corresponding to the embodiment of FIG. 4.

In accordance with the variation of the embodiment shown in FIGS. 4 and 5, the unit may be of modular structure to facilitate its transportation and handling in restricted spaces, such as in small or high-occupancy rooms, such a unit being divided into two laterally adjacent modules (1–1') of similar size. In this case, each of the modules (1–1') would be equipped with its own set of wheels (3–3') in order to comprise a totally free-standing sub-unit for transportation purposes. One of these two modules, specifically module (1'), would contain a handle (2') in addition and parallel to the handle (2) located on the other module (1).

Notwithstanding, these two modules (1–1') may be connected together, in order to form a single unit when appropriate or necessary. For this reason, module (1) is equipped with anchoring devices (22–22') located at the upper and lower ends in the area for connection to module (1'). Such anchoring devices protrude towards module (1') and end in pivots (23) pointing downwards. By slightly elevating module (1) with respect to module (1'), the anchoring devices (22–22') can be inserted into holes (24–24').

Evidently, in order for the lower connectors (22) of module (1) to enter the holes (24') of module (1'), the latter module must be equipped with windows (25), which are at the lower level of the connecting wall to module (1). The dimensions and locations of the windows are appropriate for the insertion of such connection devices (22').

Logically, this modularity requires all electrical elements to be housed in one of the two modules, specifically module (1'), in order to avoid the necessity of installing electrical connections between the modules, module (1) thus being limited to the support of accessories not requiring any type of electrical installation.

It is evident that, although the unit described is intended for use preferably in hospitals and similar locations as a hair care unit, it may likewise be used in other fields and locations and even in beauty salons themselves, as well as in old-people's homes, etc.

I claim:

1. A mobile unit for hair care services in hospitals and similar locations, essentially characterized in that it has a generally prismatic body (1), means (3) for transportation attached to the body (1), doors (10) disposed on the body (1) for enclosing a pair of tanks (12) for holding clean water and dirty water, an electrical device for heating the clean water held in the tanks, shelves (11) included in the body (1) for storing hair care utensils, a tray (13) and a shower head (14) further included in the body (1), wherein the shower head is connected to the clean water tank (12), wherein the tray (13) is associated with a pipe connected to the dirty water tank, a clean water pump and a dirty water pump being included (9), and a mirror (5) being hinged on a panel, on the side of which there also is a handle (2) for maneuvering and transporting of the unit, wherein the tray is mounted on an additional adjustable-tilt frame stand (15), the frame stand including a pair of rings (18), through which a rigid tube (19) from the tray (13) is passed to mount the tray to the frame stand and enable personal hygiene services to be provided to persons who are bedridden.

2. A mobile unit for hair care services in hospitals and similar locations, essentially characterized in that it has a generally prismatic body (1), means (3) for transportation attached to the body (1), doors (10) disposed on the body (1) for enclosing a pair of tanks (12) for holding clean water and dirty water, an electrical device for heating the clean water held in the tanks, shelves (11) included in the body (1) for storing hair care utensils, a tray (13) and a shower head (14) disposed on top of the body (1), wherein the shower head is connected to the clean water tank (12), wherein the tray (13) is associated with a pipe connected to the dirty water tank, a clean water pump and a dirty water pump being included (9) and a mirror (5) being hinged on a panel, on the side of which there also is a handle (2) for maneuvering and transporting of the unit, wherein the body is divided into two physically independent modules (1–1'), each of which is equipped with its own means (3–3') for making the unit mobile and respective handles (2–2') for maneuvering, one of such modules being equipped with pivots (23) for connection with holes (24–24') of the other module, one of the modules (1–1') of the modular structure housing all electrical components and associated items contained in the unit.

* * * * *